US006132531A

United States Patent [19]

Fang et al.

[11] Patent Number: 6,132,531

[45] Date of Patent: Oct. 17, 2000

[54] ALLOY AND CAST ALLOY COMPONENTS

[75] Inventors: Que Tsang Fang, Export; Jen C. Lin, Murrysville, both of Pa.; Manfred G. Sindel, Soest, Germany

[73] Assignee: Aluminum Company of America, Pittsburgh, Pa.

[21] Appl. No.: 09/265,520

[22] Filed: Feb. 11, 1999

Related U.S. Application Data

[63] Continuation-in-part of application No. 08/896,385, Jul. 18, 1997, abandoned.

[51] Int. Cl.[7] ..... C22C 21/06

[52] U.S. Cl. ..... 148/440; 148/549; 420/542; 420/543; 420/544; 420/546

[58] Field of Search ..... 420/542, 543, 420/544, 546; 148/549, 440

[56] References Cited

FOREIGN PATENT DOCUMENTS 4289187 10/1992 Japan .

*Primary Examiner*—Sikyin Ip
*Attorney, Agent, or Firm*—Thomas R. Trempus

[57] ABSTRACT

Alloy and cast alloy product ideally suited for use as a component in a vehicle frame or subframe, i.e., body-in-white, comprising an alloy consisting of about 2.80 to 3.60 wt. % magnesium, less than approximately 0.20 wt. % silicon, approximately 1.10 to 1.40 wt. % manganese, less than approximately 0.2 wt. % iron, less than approximately 0.15 wt. % titanium, about 0.0005 to 0.0015 beryllium, the balance substantially aluminum and incidental elements and impurities. The aluminum/magnesium alloy is typically solidified into ingot derived working stock by die casting into a shape suitable for remelt for die casting, which shape is typically an ingot billet. Excellent mechanical properties are obtained from a cast product that is not subjected to heat treating operations subsequent to casting.

12 Claims, No Drawings

ALLOY AND CAST ALLOY COMPONENTS

RELATED APPLICATIONS

This application is a continuation-in-part applications of U.S. patent application Ser. No. 08/896,385, entitled, "Alloy and Cast Alloy Components" filed on Jul. 18, 1997 now abandoned.

BACKGROUND

This invention concerns aluminum casting alloys. Principally, the invention is an improved aluminum/magnesium casting alloy and a method of producing improved aluminum/magnesium alloy products by means of die casting operations.

It is known to manufacture a vehicle frame by providing separate subassemblies, each subassembly being composed of several separate components. Each subassembly is manufactured by joining together several tube-type members with tube and socket joint or by means of a node structure that can be a cast component. A cast node can be formed from a single cast member or two or more cast members that are joined to form a node. A node typically consists of a structure with one or more connection points, e.g., arms or sockets, to which, for example, a cast, extruded, or sheet member can be connected by various joining techniques, such as by means of weld, adhesives, or mechanical devices. The frames and subframes can be assembled by adhesive or other bonding or by combinations of these and other joining techniques. An example of such a vehicle frame structure is available in U.S. Pat. No. 4,618,163, entitled "Automotive Chassis" the contents of which are incorporated herein by reference. This structural configuration for a vehicle frame is often referred to as a "space frame." Aluminum is a highly desirable metal for such vehicle frame constructions because of its light weight compared to a typical steel component and aluminum's energy absorption properties. Aluminum alloys also improve the vehicle's frame stiffness. More importantly, an aluminum vehicle frame demonstrates the strength and crash worthiness typically associated with much heavier, conventional steel frame vehicle designs. The lightweight aluminum vehicle frame also provides numerous environmental benefits and efficiencies through reduced fuel consumption and the opportunity ultimately to recycle the aluminum frame when the useful life of the vehicle is spent.

Conventional aluminum/magnesium casting alloys have many attractive properties, such as high ultimate tensile strength (>40 ksi) and elongation (>8%) with moderate yield strength (>16 ksi). However, in the preparation of component parts for automotive frame assemblies, sub assemblies, and components, it is desirable to have component parts characterized by higher elongations, while maintaining acceptable strength, stress-corrosion resistance, and other properties important to vehicle "space frame" applications.

Current practice in the manufacture of automotive components used in a "space frame" structure as disclosed in the aforementioned U.S. Pat. No. 4,618,163 includes using aluminum/silicon casting alloys. One example of such an aluminum/silicon casting alloy is disclosed in U.S. Pat. No. 5,250,125, entitled "Process for Grain Refinement of Aluminum Casting Alloys, in Particular Aluminum/Silicon Casting Alloys" to Koch et al., the contents of which are incorporated herein by reference as if fully set forth. By way of an additional example, the assignee of the instant invention has previously disclosed in U.S. Pat. No. 5,076,344 entitled "Die Casting Process and Equipment," a casting alloy capable of meeting the requirements of the space frame cast nodes without the economic liability of expensive constituents. The use of aluminum/silicon alloys requires the post casting solution heat treatment, quenching, and aging of the cast component in order for the component to exhibit the desired mechanical properties. Unfortunately, solution heat treatment and quenching can often cause some degree of distortion to the cast component and the reworking of the cast component to correct heat treatment distortion is a time and labor intensive activity. U.S. Pat. No. 5,667,602, Alloy for Cast Components, which is assigned to the assignee of the present invention and the contents of which are incorporated herein by reference, discloses an aluminum—magnesium alloy that is not subjected to high temperature heat treating operations subsequent to the completion of the casting operation. Notwithstanding such efforts to develop alloys that offer the desired properties and characteristics, there remains a need for improved alloys that are more cost effective and that do not require heat treatment subsequent to the casting operation while meeting all of the property requirements described above.

It is an object of this invention to provide an aluminum/magnesium alloy ideally suited for use in shape die casting operations.

It is another object of the invention to provide an aluminum/magnesium alloy product characterized by the elimination of solution heat treatment and aging.

It is also an object of this invention to provide an aluminum/magnesium alloy capable of an increased range of shapes and improved dimensional stability for use in the manufacture of aluminum intensive vehicles.

It is an object of this invention to provide improved cast products and components consisting of an improved aluminum/magnesium alloy cast members that ideally are suited for frames, subframes, and frame members in vehicle primary structures.

It is yet another object of this invention to provide an alloy that is idealy suited for die casting operations.

SUMMARY OF THE INVENTION

The above as well as other objects of this invention are achieved by way of the instant invention in which the alloy composition is formulated to contain about 2.80 to 3.60 wt. % magnesium, less than approximately 0.20 wt. % silicon, approximately 1.10 to 1.40 wt. % manganese, less than approximately 0.20 wt. % iron, about 0.10 to 0.15 wt. % titanium, about 0.0005 to 0.0015 beryllium, the balance substantially aluminum and incidental elements, and impurities. Unless indicated otherwise, all composition percentages set forth herein are by weight. This aluminum alloy eliminates the need for post casting solution heat treat, quenching operations, and aging. The alloy composition of this invention is therefore ideally suited for the improved post casting processing, i.e., the elimination of conventional high temperature solution heat treating and aging, while providing even complexly shaped cast products characterized by improved dimensional stability and mechanical properties.

DETAILED DESCRIPTION OF THE INVENTION

In accordance with this invention, the alloy composition is formulated to contain about 2.80 to 3.60 wt. % magnesium, less than approximately 0.20 wt. % silicon, approximately 1.10 to 1.40 wt. % manganese, less than about 0.20 wt. % iron, about 0.10 to 0.15 wt. % titanium, about 0.0005 to 0.0015 beryllium, the balance substantially aluminum and incidental elements and impurities. It is believed that the presence of beryllium in an amount up to about 10 ppm, and preferably in the range of 5 to 10 ppm reduces oxidation in the cast product without adversely affecting the desired properties of the cast product. The alloy is typically solidified into ingot-derived stock by continuous casting or semi-continuous casting into a shape suitable for remelt for casting, which shape is typically an ingot billet.

In connection with the present invention, aluminum/magnesium casting alloys are understood as meaning aluminum casting alloys containing magnesium as the main alloying element. The concept of aluminum/magnesium casting alloys consequently also implies alloys containing further alloying elements, special additions, and commercial impurities, and comprises both primary and remelted alloys. Depending on the field of application, the magnesium content of aluminum/magnesium casting alloys is preferably between about 2.80 wt. % and 3.60 wt. %.

According to the instant invention, the aluminum/magnesium cast component does not require a solution heat treatment an aging. It has been found that this aluminum/magnesium alloy according to the instant invention with an addition of manganese has demonstrated significant levels of strength and elongation for many complex structural applications, especially for automotive frame components. The alloy demonstrates a high resistance to oxidation, general corrosion, and stress corrosion. Components cast from this alloy demonstrate surprisingly high levels of weldability to common extrusion alloys as evidenced by the quality of the weld bond. It has been found that automotive frame components cast from this alloy exhibit high energy absorption without severe fracture. A sample cast product was subjected to compressive loading by means of a static axial crush test. During this test, a specified length of an energy absorbing component is compressively loaded at a predetermined rate creating a final deformed component height of approximately half the original free length or less. An ideal response for evaluation of energy absorbing components is stable collapse characterized by an absence of substantial fractures. Components of the alloy of this invention demonstrate acceptable performance with only minimal fracturing. Moreover, the instant aluminum-magnesium alloy is environmentally friendly and is readily recyclable because it does not contaminate the wrought alloy stream of recycled materials. Accordingly, there is less need to segregate cast members made according to the instant invention from the remainder of the recycled automobile aluminum components.

The compositions of sample products cast from the alloy compositions of this invention are shown in Table I.

TABLE I

| | Mg | Mn | Fe | Si | Ti | Be |
|---|---|---|---|---|---|---|
| Sample I | 3.41 | 1.28 | 0.15 | 0.19 | 0.09 | 0.0013 |
| Sample II | 3.30 | 1.24 | 0.06 | 0.17 | 0.11 | 0.0007 |
| Sample III | 3.16 | 1.21 | 0.06 | 0.19 | 0.13 | 0.0009 |
| Sample IV | 2.92 | 1.22 | 0.09 | 0.16 | 0.12 | 0.0008 |

In Table II, the as die cast samples of the alloy of this invention (Tab. I Samples) are compared to a commercial Al—Si—Mg alloy with about 10 wt. % Si, 0.18 wt. % Mg, and 0.6 wt. % Mn (Commercial) with a—T6 temper that is employed in the production of cast components for automotive applications. The commercial Al—Si—Mg alloy is used to produce a cast product that requires a solution heat treatment and quenching operation. The results presented in Table II are the average TYE properties of the samples die cast and tested. Specifically, Samples I and II represent over sixty tested components having a 3.8 mm wall thickness. Sample III is the average TYE properties of 14 die cast components having a 5.0 mm wall thickness. Sample IV is the average TYE properties of twenty die cast components having a 3.0 mm wall thickness.

TABLE II

| Alloy | Casting Method | Temper | TYS Mpa | UTS Mpa | Elongation Percent | Kahn Tear kJ/m$^2$ |
|---|---|---|---|---|---|---|
| Sample I | Vacuum Die Cast | F | 153 | 268 | 20.2 | 139 |
| Sample II | Vacuum Die Cast | F | 142 | 242 | 17.4 | |
| Sample III | Vacuum Die Cast | F | 128 | 232 | 16.7 | |
| Sample IV | Vacuum Die Cast | F | 132 | 237 | 17.0 | |
| Commercial Al—Si—Mg | Vacuum Die Cast | T6 | 125 | 190 | 17 | 104 |

As can be appreciated, the Al—Mg alloy of the instant invention produces a die cast component that does not require the solution heat treat, quenching, and aging of conventional Al—Si—Mg alloys to obtain the desired mechanical properties and characteristics required for many applications, including for example, vehicle components. The alloy of this invention requires no solution heat treatment/quench/aging, and thus will provide the surprising advantage of significant cost savings through reduced capital and elimination of floor space required for heat treatment equipment, reduced heat treatment operation cost, reduced part distortion, increased throughput, and reduced waste water treatment.

Unless indicated otherwise, the following definitions apply herein:

a. Percentages for a composition are on a weight basis (wt. %).

b. In stating a numerical range or a minimum or a maximum for an element of a composition or other process matter or any other matter herein, and apart from and in addition to the customary rules for rounding off numbers, such is intended to specifically designate and disclose each number, including each fraction and/or decimal, (i) within and between the stated minimum and maximum for a range, or (ii) at and above a stated minimum, or (iii) at and below a stated maximum. (For example, a range of 2 to 5 discloses 2.0, 2.1, 2.2 . . . 2.9, 3, 3.1, 3.2. . . and so on, up to 5, including every number and fraction or decimal therewithin, and "up to 5" discloses 0.01 . . . 0.1 . . . 1 and so on up to 5.)

Having described the presently preferred embodiments for an improved casting alloy, it is to be understood that the invention may be otherwise embodied within the scope of the appended claims.

What is claimed is:

1. An improved aluminum alloy for die casting operations consisting of about 2.80 to 3.60 wt. % magnesium, less than 0.20 wt. % silicon, 1.10 to 1.40 wt. % manganese, less than 0.20 wt. % iron, less than 0.15 wt. % titanium, about 0.0005 to 0.0015 beryllium, the balance consisting of aluminum and incidental elements and impurities.

2. The improved aluminum alloy according to claim 1 wherein the magnesium is in the range of 3.10 to 3.55 wt. % magnesium.

3. The improved aluminum alloy according to claim 1 wherein the manganese is in the range of 1.20 to 1.30 wt. %.

4. The improved aluminum alloy according to claim 1 wherein the beryllium is in the range of 0.0005 to 0.0010 wt. %.

5. The method of producing an improved cast aluminum alloy product comprising: providing an alloy consisting of about 2.80 to 3.60 wt. % magnesium, less than 0.20 wt. % silicon, 1.10 to 1.40 wt. % manganese, less than 0.20 wt. % iron, less than 0.15 wt. % titanium, about 0.0005 to 0.0015 beryllium, the balance consisting of aluminum and incidental elements and impurities; and casting a body of said alloy.

6. The method according to claim 5 wherein the alloy is in the range of 3.10 to 3.55 wt. % magnesium.

7. The method according to claim 5 wherein the alloy is in the range of 1.20 to 1.30 wt. % manganese.

8. The method of producing an improved cast aluminum alloy product according to claim 5 wherein the cast product is a frame member in a vehicle.

9. The method of producing an improved cast aluminum alloy product according to claim 5 wherein the alloy is about 0.0005 to 0.0010 wt. % beryllium.

10. In the production of a vehicular frame component wherein a die cast component is produced by one or more operations into said frame component, the improvement wherein the production of said cast component consists of: about 2.80 to 3.60 wt. % magnesium, less than 0.20 wt. % silicon, 1.10 to 1.40 wt. % manganese, less than 0.20 wt. % iron, less than 0.15 wt. % titanium, about 0.0005 to 0.0015 beryllium, the balance substantially aluminum and incidental elements and impurities; and die casting said frame component from said alloy.

11. A vehicle frame comprising cast components that are joined together or joined with wrought components to make a frame or subframe, wherein at least one of said cast components is an aluminum alloy consisting of about 2.80 to 3.60 wt. % magnesium, less than 0.20 wt. % silicon, 1.10 to 1.40 wt. % manganese, less than 0.20 wt. % iron, less than 0.15 wt. % titanium, about 0.0005 to 0.0015 beryllium, the balance substantially aluminum and incidental elements and impurities.

12. The method of producing an improved die cast aluminum alloy product comprising: providing an alloy consisting of about 2.80 to 3.60 wt. % magnesium, less than 0.20 wt. % silicon, 1.10 to 1.40 wt. % manganese, less than 0.20 wt. % iron, less than 0.15 wt. % titanium, about 0.0005 to 0.0015 beryllium, the balance substantially aluminum and incidental elements and impurities; and die casting a component of said alloy.

* * * * *